US007908942B1

(12) United States Patent
Mitchell

(10) Patent No.: US 7,908,942 B1
(45) Date of Patent: Mar. 22, 2011

(54) JAR LID OPENER

(76) Inventor: Elena A. Mitchell, Anchorage, AK (US)

( * ) Notice: Subject to any disclaimer, the term of this patent is extended or adjusted under 35 U.S.C. 154(b) by 233 days.

(21) Appl. No.: 12/288,784

(22) Filed: Oct. 23, 2008

(51) Int. Cl.
*B67B 7/16* (2006.01)

(52) U.S. Cl. ..... 81/3.55; 81/3.57

(58) Field of Classification Search ..... 81/3.55–3.57; D8/33, 40
See application file for complete search history.

(56) References Cited

U.S. PATENT DOCUMENTS

| | | | | | |
|---|---|---|---|---|---|
| 593,377 | A | * | 11/1897 | Johnson | 81/3.55 |
| 758,928 | A | * | 5/1904 | McGrath | 7/119 |
| 894,626 | A | | 6/1908 | Givens | |
| 1,040,564 | A | * | 10/1912 | Merrill | 81/3.35 |
| 1,211,233 | A | * | 1/1917 | Rhonemus | 81/3.56 |
| 1,676,648 | A | * | 7/1928 | Hardiman | 81/3.57 |
| 1,676,649 | A | * | 7/1928 | Podel | 81/3.57 |
| 1,736,519 | A | * | 11/1929 | Bucholtz | 81/3.41 |
| 1,820,575 | A | * | 8/1931 | Mayhew | 81/3.57 |
| 1,913,816 | A | * | 6/1933 | Osborne | 81/3.57 |
| 2,106,639 | A | * | 1/1938 | Jenkinson | 81/3.55 |
| D126,898 | S | * | 4/1941 | White | D8/40 |
| 2,455,752 | A | * | 12/1948 | Geh | 81/3.56 |
| 2,710,551 | A | * | 6/1955 | Walters | 81/3.56 |
| 2,931,258 | A | | 4/1960 | Ronning, Jr. | |
| 2,990,213 | A | | 6/1961 | Kolacinski | |
| 3,885,478 | A | * | 5/1975 | Evans | 81/3.55 |
| D278,023 | S | * | 3/1985 | Junes | D8/40 |
| 4,747,173 | A | * | 5/1988 | Marceau | 7/156 |
| 5,031,485 | A | | 7/1991 | Wu | |
| 5,069,090 | A | * | 12/1991 | Clark | 81/3.09 |
| 5,222,265 | A | * | 6/1993 | Hermansson | 7/156 |
| 5,241,719 | A | * | 9/1993 | Memmelaar | 7/156 |
| D350,264 | S | | 9/1994 | Friend | |
| 5,465,430 | A | * | 11/1995 | Davis et al. | 29/267 |
| 5,476,023 | A | * | 12/1995 | Calandro | 81/3.57 |
| D371,287 | S | | 7/1996 | Gilbert, Jr. | |
| 5,931,059 | A | * | 8/1999 | Hammer | 81/3.57 |
| D440,842 | S | | 4/2001 | Vandergaw | |
| 6,378,398 | B2 | * | 4/2002 | Brix-Hansen | 81/3.57 |
| 6,983,559 | B1 | | 1/2006 | Kraus | |
| 7,114,233 | B1 | * | 10/2006 | Wyrick et al. | 29/426.5 |
| 7,313,983 | B1 | * | 1/2008 | Book | 81/3.55 |
| 2004/0011160 | A1 | * | 1/2004 | Crowley | 81/3.55 |
| 2006/0101947 | A1 | * | 5/2006 | Pratt | 81/3.57 |

* cited by examiner

*Primary Examiner* — David B Thomas
(74) *Attorney, Agent, or Firm* — Montgomery Patent and Design; Robert C. Montgomery

(57) ABSTRACT

A device designed to aid in opening jars is herein disclosed, comprising a general form of a lever with a movable "C"-shaped jaw section. An upper jaw is designed to press down in the center area of a lid while a lower jaw presses upward on the edge or rim of the lid. In such a manner the device will break the seal of the jar and "pop" the lid. Once the seal has been broken, it is generally a simple issue to open the lid. An alternate embodiment provides for a lower adjustable section of the jaw which operates in a slip-joint manner similar to that of a pair of Channel-Lock® pliers to accommodate any size lid. The handle is fitted with a grip area for each finger and is covered with non-slip rubber to facilitate use and comfort. The device is generally small in size and can be easily stored in a kitchen drawer.

15 Claims, 6 Drawing Sheets

JAR LID OPENER

RELATED APPLICATIONS

The present invention was first described in a notarized Official Record of Invention on Dec. 5, 2007, that is on file at the offices of Montgomery Patent and Design, LLC, the entire disclosures of which are incorporated herein by reference.

FIELD OF THE INVENTION

The present invention relates generally to a device to aid in opening jars and, more particularly, to said device comprising an upper jaw designed to press down in a center area of a lid while a lower jaw presses upward on an edge or rim of the lid, thereby breaking a seal of the jar and making it easier for a user to open the lid.

BACKGROUND OF THE INVENTION

A great deal of food products are shipped and stored in glass jars with metal lids. While such a storage method has worked well for years and will likely be around for many more years in the future, it is not without its disadvantages. Perhaps the biggest of these disadvantages is the difficulty encountered when opening the jar for the first time. Even the strongest of us sometimes have difficulty in open such jar lids and must resort to aids such as flexible grippers, rapping the lid with a table knife handle, or similar actions. However such aids still rely on physical strength and/or are not effective. Such efforts are difficult and waste time for the even the strongest person, but those who are elderly, disabled, small in stature, or those with reduced diminished strength find the task impossible. Accordingly, there exists a need for a means by which jars can be opened in an easy manner without the disadvantages as listed above. The development of the invention herein described fulfills this need.

A particular problem arises from jars that have been used for canning. These jars are made of glass. Inserting a table knife between the lid and the glass container can cause the jar to break or at least chip, resulting in a possible injury. These jars are difficult to open with available means such as a gripping pad. The use of the device described herein will greatly aid those attempting to open jars that have been used for canning.

There have been attempts made in the past to develop openers for jars. U.S. Pat. No. D 440,842 issued to Vandergaw discloses a jar opener that appears to comprise a pair of gripping surfaces that attach to the lateral surfaces of a jar lid and utilize a handle to torque the lid from the jar. Unfortunately, this design patent does not appear to be similar in appearance to the disclosed device, nor does it appear to disclose a jar lid opener that is capable of utilizing a hook and a handle to remove the vacuum from a jar before applying rotational force to a jar lid.

U.S. Pat. No. D 371,287 issued to Gilbert appears to disclose a pair of pliers for a drain nut. Unfortunately, this design patent does not appear to be similar in appearance to the disclosed device, nor does it appear to disclose a jar lid opener that is capable of utilizing a hook and a handle to remove the vacuum from a jar before applying rotational force to a jar lid.

U.S. Pat. No. D 350,264 issued to Friend appears to disclose a traditional jar opener that punctures the lid of a can or jar with a handle that appears to be capable of reducing pressure inside of a jar. Unfortunately, this design patent does not appear to be similar in appearance to the disclosed device, nor does it appear to be capable of applying rotational torque to a jar lid.

U.S. Pat. No. 5,031,485 Wu appears to disclose a container lid opener comprising a lever arm, a support arm, and a grasp block that encircles a jar lid to provide rotational torque for removal of said lid. Unfortunately, this patent does not appear to disclose a jar lid opener that comprises a hook that may be used to reduce pressure within a jar and to consequently make the application of rotational force to torque the jar lid open easier.

U.S. Pat. No. 2,990,213 issued to Kolacinski discloses a holding device that appears to be a similar to a pair of pliers with a movable plate on the upper arm. Unfortunately, this patent does not appear to disclose a jar lid opener that comprises an upper jaw assembly, a hook, and a handle to vent air into a jar and permit the application of rotational torque to open a jar lid.

U.S. Pat. No. 2,931,258 issued to Ronning discloses an opener for screw caps that appears to be a device that permits width adjustment for various jar lids and uses rotational torque to remove the lids. Unfortunately, this patent does not appear to be similar in appearance to the disclosed device, nor does it appear to disclose a jar lid opener that is capable of utilizing a hook and a handle to remove the vacuum from a jar before applying rotational force to a jar lid.

U.S. Pat. No. 894,626 issued to Givens appears to disclose a jar opener comprising a pair of handles attached to a gripping section that are applied laterally about a jar lid for the application of rotational torque to open a jar. Unfortunately, this patent does not appear to disclose a jar lid opener that comprises a hook that may be used to reduce pressure within a jar and to consequently make the application of rotational force to torque the jar lid open easier.

None of the prior art particularly describes a device to aid in opening jars comprising an upper jaw designed to press down in a center area of a lid while a lower jaw presses upward on an edge or rim of the lid, thereby breaking a seal of the jar and making it easier for a user to open the lid that the instant invention possesses. Accordingly, there exists a need for a means by which jars can be opened in an easy manner that operates without the disadvantages as described above.

SUMMARY OF THE INVENTION

In light of the disadvantages as described above in the prior art, it is apparent that there is a need for a jar lid opener which provides a means for overcoming a vacuum-sealed lid by introducing air into a vacuum-sealed jar.

An object of the jar lid opener is envisioned to engage an outer lip of a common lid used to seal a common jar and provide a venting means thereto the internal vacuum between the jar and the sealed lid easing the lid removal process.

Another object of the jar lid opener is made of a strong, durable metal such as a steel alloy or the like which will prevent corrosion.

A further object of the jar lid opener is that it is small enough in size to be stored within a drawer or be carried with a user during outings.

An aspect of the jar lid opener comprises a handle, a "C"-shaped body, an upper jaw assembly, and a lower jaw.

Another aspect of the jar lid opener comprises a handle that acts as a lever providing a mechanical advantage along a rotational axis along the top center of the lid. The handle further comprises an ergonomic grip preferably made of a rubber material to provide a non-slip comfortable gripping surface for a hand of a user.

A further aspect of the jar lid opener is a "C"-shaped body that extends from the handle forming the mouth of the device which correspondingly engages a lip of a lid of a jar to be opened.

Still a further aspect of the jar lid opener comprises an upper jaw assembly pivotally attached thereto the distal end of the "C"-shaped body. The upper jaw assembly provides a contact surface and pivot means for the device when engaged with the top surface of the lid.

Yet another aspect of the jar lid opener comprises an upper jaw assembly further comprising a base, two (2) flanges, and a fastener. The base comprises a partially hemispherical section and a flat underside contact surface and provides a support means for the lever action of the device when engaged with the lid. The base is pivotally attached thereto the "C"-shaped body via a fastener engaging through the flanges and the "C"-shaped body and provides the axis by which the device rotates.

Still another aspect of the jar lid opener comprises a lower jaw with arcuate profile curving upwardly and comprising a pointed hook located at the distal end. The pointed hook engages the lower outside perimeter edge of the lid and provides a hooking and lifting means for the outer edge of the lid from the jar, thereby venting the internal vacuum.

Another aspect of the jar lid opener alternately adjustable jar lid comprises a sliding lower jaw, an alternate hook and a pivot. The pivot is permanently attached to the lower portion of the alternate "C"-shaped body. The sliding lower jaw comprises a mechanism that allows the pivot point to slide into one (1) of several positions thereby providing an adjustability means. The adjustable lower jaw assembly also comprises an alternate hook which engages the underside perimeter edge of the jar lid in a similar manner as the preferred hook.

An aspect of the jar lid opener alternately comprises a rigid "C"-shaped body without an upper jaw assembly. The rigid "C"-shaped body is similar to the preferred "C"-shaped body including the preferred lower jaw and hook with a rigid upper jaw. The rigid upper jaw provides a permanent rigid attachment between the rigid "C"-shaped body and the rigid base. The rigid base also comprises a contact surface.

An aspect of the jar lid opener in an alternate rigid adjustable jar lid opener comprises similar materials and functions as the adjustable jar lid opener embodiment with an alternate rigid "C"-shaped body.

Another aspect of the jar lid opener alternately comprises an alternate rigid "C"-shaped body similar to the alternate "C"-shaped body, including the adjustable lower jaw assembly, sliding lower jaw, pivot, and alternate hook with an alternate rigid upper jaw. The alternate rigid upper jaw provides a permanent rigid attachment between the alternate rigid "C"-shaped body and the alternate rigid base. The alternate rigid base further comprises a contact surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
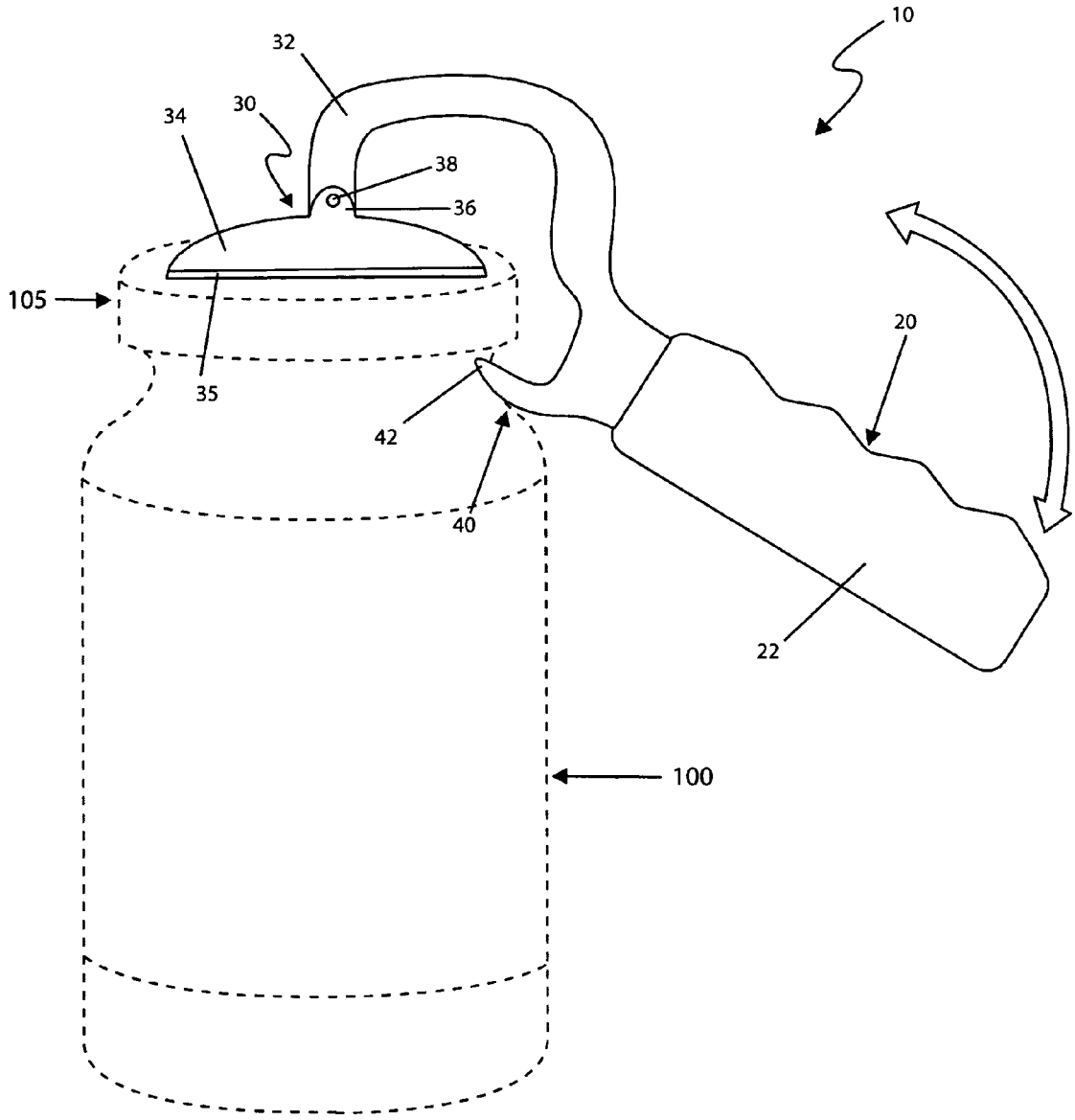
FIG. 1 is a side environmental view of a jar lid opener 10, according to a preferred embodiment of the present invention.

10 jar lid opener
20 handle
22 grip
30 upper jaw assembly
32 "C"-shaped body
33 alternate "C"-shaped body
34 base
35 contact surface
36 flange
38 fastener
40 lower jaw
42 hook
50 adjustable jar lid opener embodiment
60 adjustable lower jaw assembly
62 sliding lower jaw
64 pivot
66 alternate hook
70 rigid jar lid opener embodiment
72 rigid upper jaw
74 rigid "C"-shaped body
76 rigid base
80 rigid adjustable jar lid opener embodiment
82 alternate rigid upper jaw
84 alternate rigid "C"-shaped body
86 alternate rigid base
100 jar
105 lid

DETAILED DESCRIPTION OF THE PREFERRED EMBODIMENT

Figure 2:
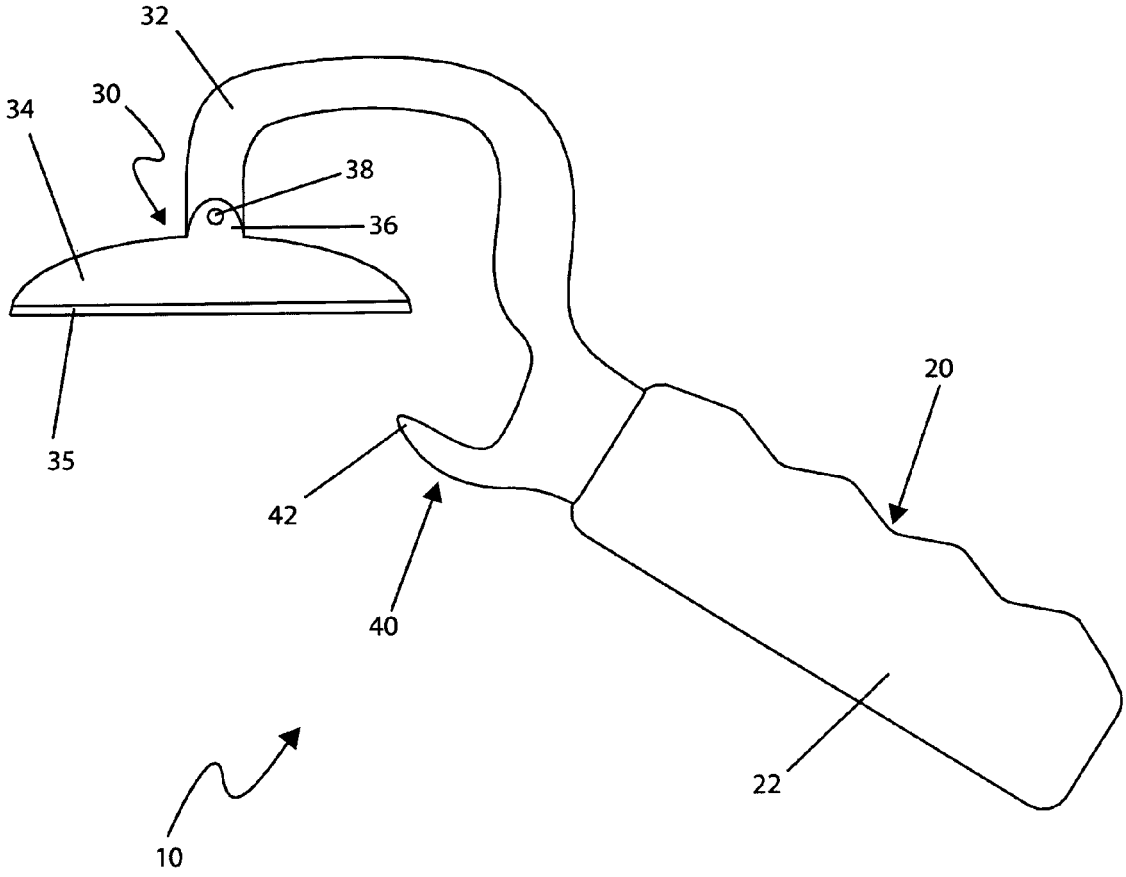
FIG. 2 is a side view of a jar lid opener 10, according to a preferred embodiment of the present invention.
Figure 3:
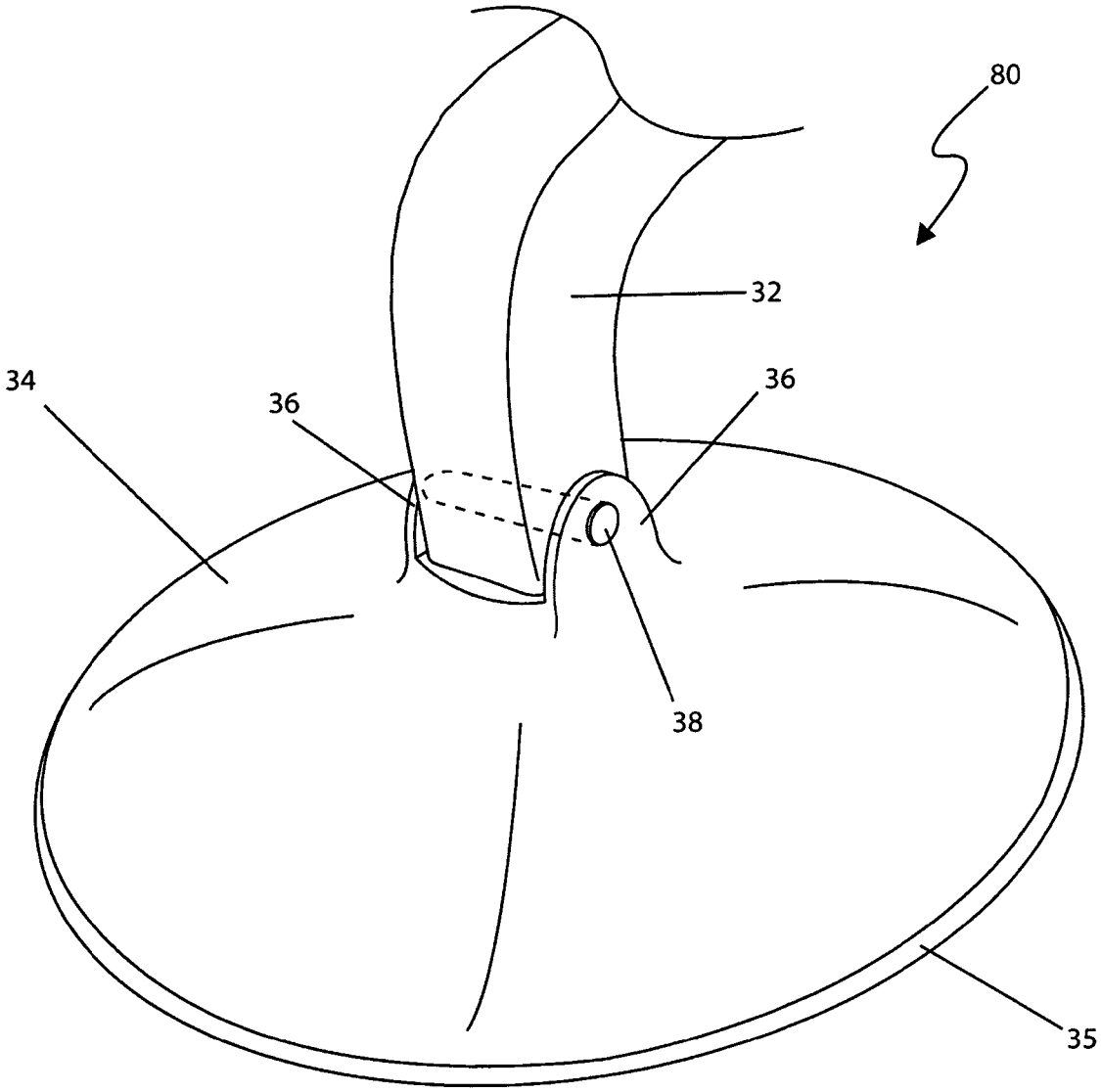
FIG. 3 is a close up perspective view of an upper jaw assembly 30, according to a preferred embodiment of the present invention.
Figure 4:
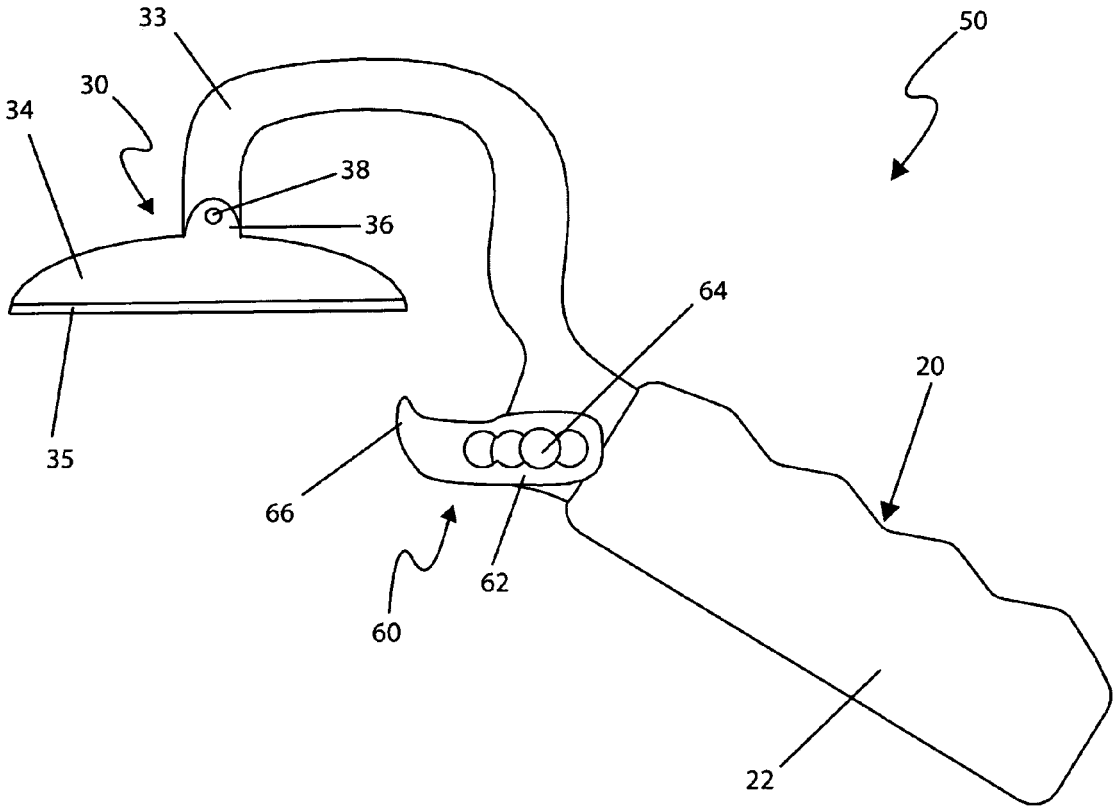
FIG. 4 is a side view of an adjustable jar lid opener embodiment 50, according to an alternate embodiment of the present invention.
Figure 5:
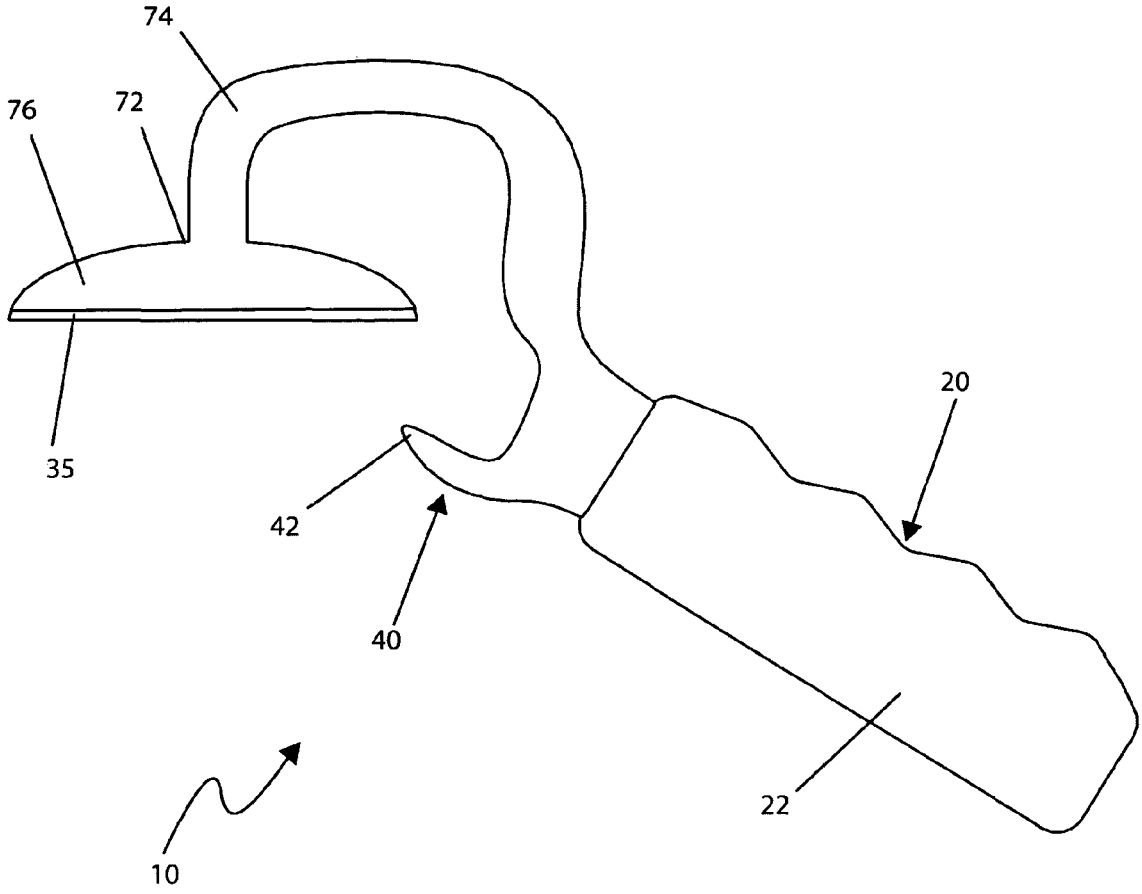
FIG. 5 is a side view of rigid jar lid opener embodiment 70, according to an alternate embodiment of the present invention; and, FIG. 6 is a side view of a rigid adjustable jar lid opener 80, according to an alternate embodiment of the present invention.
Figure 6:
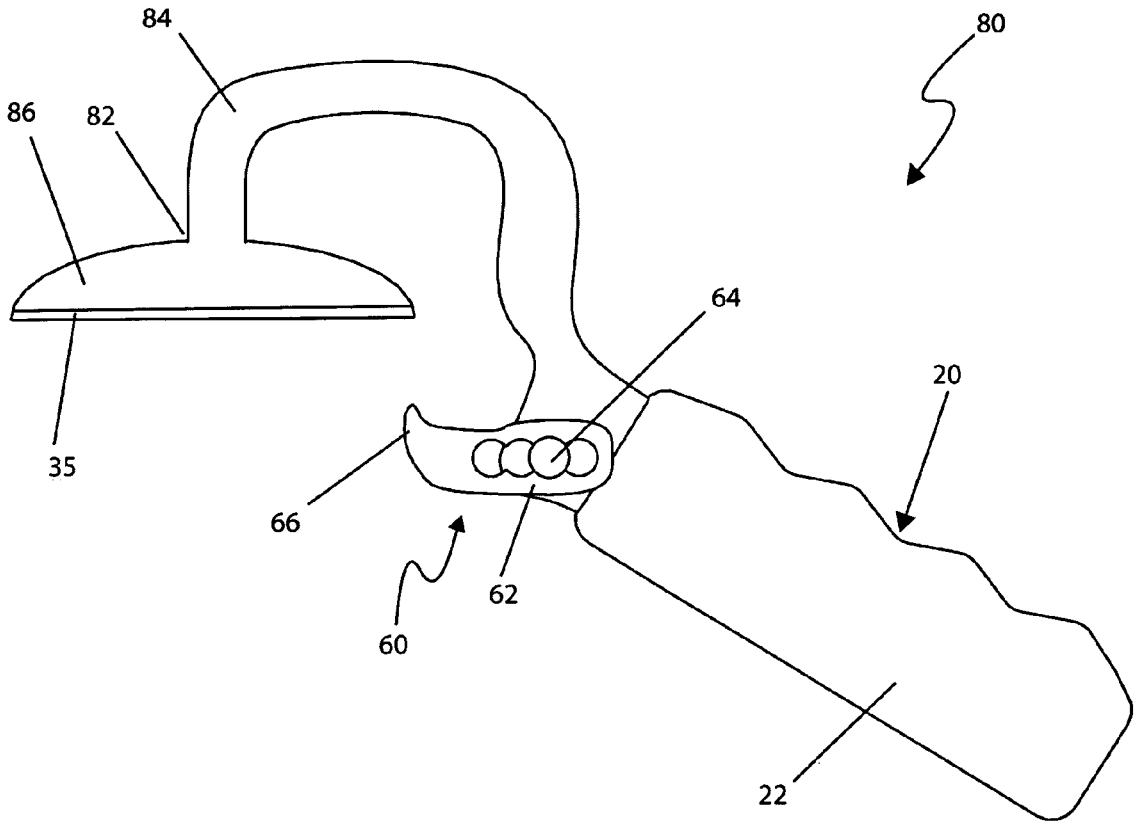

The best mode for carrying out the invention is presented in terms of its preferred embodiment, herein depicted within FIGS. 1 through 3 and alternatively in FIGS. 4 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a jar lid opener (herein described as the "device") 10, which provides a means for overcoming a vacuum-sealed lid 105 by introducing air therein a vacuum-sealed jar 100. The device 10 is envisioned to engage an outer lip of a common lid 105 used to seal a common jar 100. When engaged, the device 10 is envisioned to provide a venting means thereto the internal vacuum therebetween the jar 100 and the sealed lid 105 thereby easing the lid 105 unscrewing process.

Referring now to FIGS. 1 and 2, side views of the device 10, according to the preferred embodiment of the present invention, is disclosed. The device 10 comprises a handle 20, an upper jaw assembly 30, a "C"-shaped body 32, and a lower jaw 40. The device 10 is preferably made of a strong, durable metal such as a steel alloy or the like which will prevent corrosion. The device 10 is envisioned as being small enough in size to be stored therewithin a drawer or be carried with a user during outings. The handle 20 acts as a lever providing a mechanical advantage along a rotational axis along the top center of the lid 105. The handle 20 comprises an ergonomic grip 22 preferably made of a rubber material to provide a non-slip comfortable gripping surface for a hand of a user. The "C"-shaped body 32 extends from the handle 20 forming the mouth of the device 10 which correspondingly engages a lip of a lid 105 of a jar 100. The upper jaw assembly 30 is pivotally attached thereto the distal end of the "C"-shaped body 32. The upper jaw assembly 30 provides a contact surface and pivot means for the device 10 when engaged thereto the top surface of the lid 105. The lower jaw 40 is envisioned as having an arcuate profile curving upwardly and comprising a pointed hook 42 located thereat the distal end. The hook 42 engages the lower outside perimeter edge of the lid 105 and provides a hooking and lifting means for the outer edge of the lid 105 therefrom the jar 100, thereby venting the internal vacuum.

Referring now to FIG. 3, a close up perspective view of the upper jaw assembly 30, according to the preferred embodiment of the present invention, is disclosed. The upper jaw assembly 30 comprises a base 34, two (2) flanges 36, and a fastener 38. The base 34 comprises a partially hemispherical section and a flat underside contact surface 35 and provides a support means for the lever action of the device 10 when engaged therewith the lid 105. The contact surface 35 is preferably made of a rubber or plastic material. The base 34 is pivotally attached thereto the "C"-shaped body via a fastener 38 such as a rivet or similar means. The distal end of the "C"-shaped body 32 makes contact therebetween the two (2) flanges 36 located thereon the center of the top surface of the base 34. The fastener 38 engages therethrough the flanges 36 and the "C"-shaped body 32 and provides the axis by which the device 10 rotates.

Referring finally to FIG. 4, an alternative embodiment of the present invention 10 comprises an adjustable jar lid opener embodiment 50. The adjustable jar lid embodiment 50 comprises similar materials and functions as the preferred embodiment 10 with particular enhancements including an adjustable lower jaw assembly 60 which provides for an adjustability means for the alternate embodiment 50 to be used on a variety of sizes of jars 100 and lids 105. The alternate embodiment 50 comprises an alternate "C"-shaped body and a slip-joint similar to common Channel-Lock® type pliers. The alternate "C"-shaped body is similar to the preferred "C"-shaped body with the preferred lower jaw 40 and hook 42 removed. The adjustable lower jaw assembly 60 comprises a sliding lower jaw 62 and a pivot 64. The pivot 64 is permanently attached thereto the lower portion of the alternate "C"-shaped body 33 and is preferably a durable rivet or the like. The sliding lower jaw 62 comprises a mechanism that allows the pivot point 64 to slide into one (1) of several positions thereby providing the adjustability means for the alternate embodiment 50. The adjustable lower jaw assembly 60 also comprises an alternate hook 66 which engages the underside perimeter edge of the lid 105 in a similar manner as the preferred embodiment hook 40.

Referring finally to FIG. 5, an alternative embodiment of the present invention 10 comprises a rigid jar lid opener embodiment 70. The rigid jar lid opener 70 comprises similar materials and functions as the preferred embodiment 10 with particular enhancements including a rigid "C"-shaped body 74. The rigid "C"-shaped body 74 is similar to the preferred "C"-shaped body 32 including the preferred lower jaw 40 and hook 42 with particular enhancements including a rigid upper jaw 72. The rigid upper jaw 72 provides a permanent rigid attachment therebetween the rigid "C"-shaped body 74 and the rigid base 76. The rigid base 76 also Comprises a contact surface 35.

Referring finally to FIG. 6, an alternative embodiment of the present invention 10 comprises a rigid adjustable jar lid opener embodiment 80. The rigid adjustable jar lid opener 80 comprises similar materials and functions as the adjustable jar lid opener embodiment 50 with particular enhancements including an alternate rigid "C"-shaped body 84. The alternate rigid "C"-shaped body 84 is similar to the alternate "C"-shaped body 32 including the adjustable lower jaw assembly 60, sliding lower jaw 62, pivot 64, and alternate hook 66 with particular enhancements including an alternate rigid upper jaw 82. The alternate rigid upper jaw 82 provides a permanent rigid attachment therebetween the alternate rigid "C"-shaped body 84 and the alternate rigid base 86. The alternate rigid base 86 also comprises a contact surface 35.

The alternate embodiments 70, 80 illustrated in FIGS. 5 and 6 are envisioned to provide repeated applications to a particularly sized container 100 with a common lid 105 having the same height and diameter. The alternate embodiments 70, 80 are envisioned to be introduced in a variety of sizes based upon a particular jar lid 105 design. The alternate embodiments 70, 80 are envisioned to provide certain economic and manufacturing advantages as compared to the preferred embodiment 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 through 3.

The method of utilizing the device 10 may be achieved by performing the following steps: retrieving the device 10; retrieving an unopened jar 100 with a vacuum-sealed lid 105; securing the jar 100 therewith one (1) hand; manipulating the device 10 therewith an opposing hand; placing the contact surface 35 of the base 34 thereon the top outside surface of the lid 105; lifting the device 10 in an upward rotational motion until the tip of the hook 42 engages thereto the underneath perimeter edge of the lid 105; applying an upwardly lifting lever action thereto the device 10; pulling the outer perimeter edge of the lid 105 therefrom the jar 100; venting the internal vacuum therewithin the jar 100; disengaging the device 10 therefrom the lid 105; opening the jar 100 as normal by unscrewing the lid 105 which is now much less difficult; and, benefiting from the improved convenience and ease in jar opening afforded a user of the present invention 10.

The method of utilizing the alternate embodiment 50 may be achieved by performing similar steps as detailed in the preferred embodiment 10 with the following additional steps: sliding the adjustable lower jaw assembly 60 therealong the pivot 64 to an appropriate position based on the size of the lid 105; engaging the outer lip of the lid 105 with the alternate hook 66; pulling the outer perimeter edge of the lid 105 therefrom the jar 100; venting the internal vacuum therewithin the jar 100; disengaging the device 10 therefrom the lid 105; opening the jar 100 as normal by unscrewing the lid 105 which is now much less difficult; and, benefiting from the improved convenience and ease in jar opening afforded a user of the preferred embodiment 50.

The method of utilizing the rigid jar lid opener alternate embodiment 70 is envisioned to apply to a large quantity of same sized jars 100 and lids 105 and may be achieved by performing similar steps as detailed in the preferred embodiment 10 with the following additional steps: choosing the appropriately sized model of the rigid jar lid opener embodiment 70; engaging with a jar lid 105; and, repeating.

The method of utilizing the rigid adjustable jar lid opener embodiment 80 is envisioned to apply to a large quantity of same sized jars 100 and lids 105 and may be achieved by performing similar steps as detailed in the alternate embodiment 50 with the following additional steps: choosing the appropriately sized model of the rigid adjustable jar lid opener embodiment 80; engaging with a jar lid 105; and, repeating.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An opener device, comprising:

an elongated handle having a grip;

a generally C shaped body extending from said handle forming a mouth for receiving a lid of a container, said body further comprising a distal end and a proximal end;

a lower jaw assembly disposed at said proximal end of said body having an upwardly curved end terminating in a pointed hook; and, an upper jaw assembly pivotably connected to said distal end of said body, said upper jaw assembly further comprising a partially hemispherical base with a flat bottom surface to form a flush contact surface a top surface of said lid, a first flange and an opposing second flange extending upwardly from a top surface of said base for receiving said distal end of said body, and a fastener for connecting said base between said flanges;

wherein said handle acts as a lever providing a mechanical advantage to said hook along a rotational axis defined by said fastener along a center of said lid; and, wherein when said base is rotated about said rotational axis said hook engages a lower outside perimeter edge of said lid and vents an internal vacuum of said container, thereby allowing said lid to more easily removed.

2. The device of claim 1, wherein said lower jaw assembly further comprises a pivot pin extending outwardly from said proximal end of said base and a sliding lower jaw slidingly connected to said pivot pin for adjusting a position of said hook relative to said proximal end of said base, thereby allowing said mouth to receive a variety of different sizes of said lid.

3. The device of claim 2, wherein said sliding lower jaw further comprises:

a plurality of linearly contiguous apertures disposed therethrough, wherein said apertures receive said pivot pin;

wherein said sliding lower jaw is selectively placed in one of a plurality of operable locked positions relative to said proximal end of said base by slidingly and rotatably transitioning from one of said plurality of apertures to a forwardly or rearwardly adjacent aperture upon said pivot pin.

4. The device of claim 3, wherein said handle further comprises an ergonomic grip.

5. The device of claim 4, wherein said ergonomic grip is formed from a rubber material, thereby providing a non-slip gripping surface for a hand of said user.

6. The device of claim 5, wherein said device is formed from a corrosion resistant material.

7. The device of claim 1, wherein said lower jaw assembly is rigidly affixed to and protrudes outwardly from said proximal end of said body.

8. The device of claim 7, wherein said handle further comprises an ergonomic grip.

9. The device of claim 8, wherein said ergonomic grip is formed from a rubber material, thereby providing a non-slip gripping surface for a hand of said user.

10. The device of claim 9, wherein said device is formed from a corrosion resistant material.

11. An opener device, comprising:

an elongated handle having a grip;

a generally C shaped body extending from said handle forming a mouth for receiving a lid of a container, said body further comprising:

an upper jaw assembly disposed at a distal end of said body, said upper jaw assembly further comprising a partially hemispherical base with a flat bottom surface to form a flush contact surface a top surface of said lid; and, a lower jaw assembly disposed at a proximal end of said body having an upwardly curved end terminating in a pointed hook;

wherein said upper jaw assembly and said lower jaw assembly are rigidly affixed to said body;

wherein said handle acts as a lever providing a mechanical advantage to said hook along a rotational axis defined along a center of said lid; and, wherein when said base is rotated about said rotational axis said hook engages a lower outside perimeter edge of said lid and vents an internal vacuum of said container, thereby allowing said lid to more easily removed.

12. The device of claim 11, wherein said handle further comprises an ergonomic grip.

13. The device of claim 12, wherein said ergonomic grip is formed from a rubber material, thereby providing a non-slip gripping surface for a hand of said user.

14. The device of claim 13, wherein said device is formed from a corrosion resistant material.

15. A method for venting an internal vacuum of a sealed container, thereby allowing a lid of said container to be more easily removed said method comprising the steps of:

providing an opener device, comprising:

an elongated handle having a grip;

a generally C shaped body extending from said handle forming a mouth for receiving a lid of a container, said body further comprising a distal end and a proximal end;

a lower jaw assembly disposed at said proximal end of said body having an upwardly curved end terminating in a pointed hook, said lower jaw assembly further comprising a pivot pin extending outwardly from said proximal end of said base and a sliding lower jaw having a plurality of linearly contiguous apertures disposed therethrough and slidingly connected to said pivot pin for adjusting a position of said hook relative to said proximal end of said base, thereby allowing said mouth to receive a variety of different sizes of said lid; and, an upper jaw assembly pivotably connected to said distal end of said body, said upper jaw assembly further comprising a partially hemispherical base with a flat bottom surface to form a flush contact surface a top surface of said lid, a first flange and an opposing second flange extending upwardly from a top surface of said base for receiving said distal end of said body, and a fastener for connecting said base between said flanges;

retrieving an unopened container with a vacuum-sealed lid;

securing said container with one hand;

manipulating said device with an opposing hand;

placing said contact surface of said upper jaw assembly on said top surface of said lid;

rotatably sliding said sliding lower jaw along said pivot pin to an appropriate position based on a size of said lid;

engaging a lower outside perimeter edge said lid with said hook;

lifting said device in an upward rotational motion until a tip of said hook engages said lower outside perimeter edge of said lid;

applying an upwardly lifting motion to said device, thereby providing a mechanical advantage to said hook along a rotational axis defined by said fastener along a center of said lid;

pulling said lower outside perimeter edge of said lid away from said container;

venting an internal vacuum within said container;

disengaging said device from said lid; and opening said container by removing said lid.

* * * * *